US010087937B2

(12) United States Patent
Seong et al.

(10) Patent No.: US 10,087,937 B2
(45) Date of Patent: Oct. 2, 2018

(54) SCROLL COMPRESSOR

(71) Applicant: LG ELECTRONICS INC., Seoul (KR)

(72) Inventors: Sanghun Seong, Seoul (KR); Kitae Jang, Seoul (KR); Inho Won, Seoul (KR); Jaesang Lee, Seoul (KR); Byeongchul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 250 days.

(21) Appl. No.: 14/945,567

(22) Filed: Nov. 19, 2015

(65) Prior Publication Data

US 2016/0146208 A1 May 26, 2016

(30) Foreign Application Priority Data

Nov. 24, 2014 (KR) ..... 10-2014-0164723

(51) Int. Cl.

| | |
|---|---|
| ***F01C 1/063*** | (2006.01) |
| ***F04C 18/063*** | (2006.01) |
| ***F03C 2/02*** | (2006.01) |
| ***F04C 14/24*** | (2006.01) |
| ***F04C 29/00*** | (2006.01) |

(Continued)

(52) U.S. Cl.

CPC ..... *F04C 29/005* (2013.01); *F04C 18/0215* (2013.01); *F04C 29/0021* (2013.01); *F04C 29/02* (2013.01); *F04C 2240/807* (2013.01)

(58) Field of Classification Search

CPC ..... F04C 29/0021; F04C 29/005

USPC ..... 418/55.1–55.6, 91, 57

See application file for complete search history.

(56) References Cited

U.S. PATENT DOCUMENTS 5,370,513 A * 12/1994 Fain ..... F04C 18/0215 418/151

5,542,830 A * 8/1996 Yuzaki ..... F04C 29/02 184/6.16

(Continued)

FOREIGN PATENT DOCUMENTS

| | | |
|---|---|---|
| CN | 101046200 | 10/2007 |
| JP | 03-018680 | 1/1991 |

(Continued)

OTHER PUBLICATIONS

Chinese Office Action dated Jun. 28, 2017 issued in Application No. 201510783279.X (with English Translation).

*Primary Examiner* — Deming Wan

(74) *Attorney, Agent, or Firm* — KED & Associates, LLP

(57) ABSTRACT

A scroll compressor is provided, in which a balancing space may be formed on a sub frame to accommodate at least one balance weight, and an oil discharge hole may be formed on a main frame, thereby suppressing, all from being introduced into or remaining in the balancing space to minimize agitation loss due to oil agitation in the balancing space, and forming a thrust surface of the main frame adjacent to an axial center of the drive shaft to suppress axial leakage at a central portion of the orbiting scroll, reducing a size of the main frame to reduce a total weight of the compressor, facilitating a centering operation of the sub frame, and suppressing an outer diameter of the sub frame from being increased, thereby accomplishing miniaturization of the scroll compressor.

16 Claims, 10 Drawing Sheets

(51) Int. Cl.
*F04C 18/02* (2006.01)
*F04C 29/02* (2006.01)

(56) References Cited

U.S. PATENT DOCUMENTS

| | | | | | |
|---|---|---|---|---|---|
| 5,951,271 | A * | 9/1999 | DuMoulin | F04C 27/005 | 418/55.3 |
| 6,077,060 | A * | 6/2000 | Watanabe | F04C 29/0021 | 418/151 |
| 6,672,846 | B2 * | 1/2004 | Rajendran | F04C 18/0215 | 417/410.5 |
| 8,047,823 | B2 * | 11/2011 | Takei | F04C 18/0215 | 184/6.18 |
| 2007/0231171 | A1 * | 10/2007 | Tsuchiya | F04C 18/0215 | 418/55.1 |
| 2008/0170955 | A1 * | 7/2008 | Eber | F04C 18/0215 | 418/55.3 |

FOREIGN PATENT DOCUMENTS

| | | |
|---|---|---|
| JP | 04-022787 | 1/1992 |
| JP | 05-302579 | 11/1993 |
| JP | 08-035497 | 2/1996 |
| JP | 2002-295380 | 10/2002 |

* cited by examiner

SCROLL COMPRESSOR

CROSS-REFERENCE TO RELATED APPLICATION(S)

The present application claims priority to Korean Application No. 10-2014-0164723, filed in Korea on Nov. 24, 2014, which is herein expressly incorporated by reference in its entirety.

BACKGROUND

1. Field

A scroll compressor is disclosed herein.

2. Background

In general, a compressor is a device that compresses a fluid, such as refrigerant gas, and may be classified into a rotary compressor, a reciprocating compressor, or a scroll compressor, for example according to a method of compressing the fluid.

The scroll compressor is a high-efficiency, low-noise compressor widely applicable in the field of air conditioners. The scroll compressor may be configured with an orbiting scroll having a wrap (hereinafter, an "orbiting wrap") and a non-orbiting scroll (hereinafter, a "fixed scroll") having a wrap (hereinafter, a "fixed wrap") engaged with the orbiting wrap to perform a relative orbiting movement. Further, the scroll compressor may perform a method of forming a plurality of compression chambers including a suction chamber, an intermediate pressure chamber, aid a discharge chamber between the orbiting wrap and fixed wrap during a process in which the orbiting scroll and the fixed scroll perform a relative orbiting movement, consecutively suctioning in, compressing, and discharging a refrigerant as a volume of the plurality of compression chambers is decreased while the plurality of compression chambers continuously move in a central direction.

The scroll compressor may be divided into a dosed type in which a compression mechanism and an electric mechanism are installed together in a sealed casing, and an open type, in which a drive source is located outside of a casing and a compression mechanism operated by the drive source is installed inside of the casing.

FIG. 1 is a longitudinal cross-sectional view of an open scroll compressor according to the related art. As described herein, in the open scroll compressor according to the related art, a main frame 2 is installed in an inner space of a casing and an end of a drive shaft 3 is inserted into the main frame 2 to be rotatably coupled thereto.

An orbiting scroll 4 is coupled to an end of the drive shaft 3, and a fixed scroll 5 is coupled to the orbiting scroll 4. The fixed scroll 5 is coupled to the main frame 2 with the orbiting scroll 4 interposed therebetween. An orbiting wrap 4*a* and a fixed wrap 5*a* are formed on the orbiting scroll 4 and fixed scroll 5, respectively. The orbiting wrap 4*a* and fixed wrap 5*a* are engaged with each other to form a plurality of compression chambers (P) including a suction chamber, an intermediate pressure chamber, and a discharge chamber.

A suction portion 5*b* that communicates with the suction chamber and a discharge port (not shown) that communicates with the discharge chamber, are formed at one side of the fixed scroll 5 and at a center of the fixed scroll 5, respectively. The discharge port communicates with a discharge space 1*b* of the casing 1 whereas the suction portion 5*b* is connected to a suction space 1*a* of the casing 1, which is connected to a suction pipe.

While a first end of the drive shaft 3 is supported by the main frame 2, a second end surrounding the drive shaft 3 is supported by a sub frame 6 coupled to the main frame 2. A bearing 7 that supports the drive shaft 3 in a radial direction is installed on the bearing 7.

A balance weight 8 is provided at one side of the drive shaft 3, and a balancing space 2*a* is formed on the main frame 2 to accommodate the balance weight 8. The balancing space 2*a* is concavely formed by a predetermined depth at a lateral center of the balance weight 8 and a thrust surface 2*b* that supports the orbiting scroll 4 in an axial direction is formed on a lateral surface of the main frame 2 surrounding the balancing space 2*a*. An extended protrusion 2*c* that extends in a radial direction is formed at one end of an inner surface that forms the balancing space 2*a* to form a bottom surface of the balancing space 2*a*, and a bearing hole 2*d* is formed at a center of the extended protrusion 2*c* to allow the drive shaft 3 to pass therethrough.

The balancing space 2*a* is formed in a half-sealed type or partially-sealed to collect oil supplied to a bearing surface through an oil passage 3*a* of the drive shaft 3. Accordingly, a scatter hole (not shown) to scoop the collected oil in the balancing space 2*a* while the balance weight 8 rotates along with the drive shaft 3 is formed on an inner circumferential surface of the extended protrusion 2*c* or the balancing space 2*a*.

A front cover 9, which forms a portion of the casing 1, is coupled to the sub frame 6, and an oil pump 10 that pumps oil stored in the casing 1 to a sliding portion and the compression mechanism is installed on the front cover 9. The oil pump 10 is coupled to the second end of the drive shaft 3, and the drive shaft 3 is coupled to a drive pulley 1 provided at an outside of the casing 1 through the front cover 9. The drive pulley 11 is selectively connected to an external drive source (not shown) driven by gas to drive the compression mechanism according to need.

Reference numeral 2*e* in the drawings is an axially extended portion of the main frame 2.

According to the related art open scroll compressor t, the drive pulley 11 is coupled to a drive source (not shown) to transmit an external drive force to the compression mechanism through the drive shaft 3. Then, the orbiting scroll 4 coupled to the drive shaft 3 performs an orbiting movement by an eccentric distance in a state of being supported by the main frame 2, and at a same time, a plurality of compression chambers (P) including a suction chamber, an intermediate pressure chamber, and a discharge chamber formed between the orbiting wrap 4*a* and the fixed wrap 5*a* are consecutively formed. The plurality of compression chambers (P) move to a center due to a continuous orbiting movement of the orbiting scroll 4, and as a volume is decreased refrigerant introduced into the suction space 1*a* of the casing 1 is consecutively suctioned in, compressed, and then discharged to the discharge space 1*b*.

During this process, the oil pump 10 generates a pumping force while being rotated by the drive shaft 3, and oil collected at a lower half portion of the suction space 1*a* of the casing 1 is pumped by the pumping, force, and supplied to each sliding portion and the compression mechanism through the oil passage 3*a* of the drive shaft 3. Then, a portion of the oil supplied between the orbiting scroll 4 and the drive shaft 3 through the oil passage 3*a* flows down and is collected into the balancing space 2*a*. The oil is suctioned up through the scatter hole (not shown) when the balance weight 8 rotates along with the drive shaft 3 and moves into the suction space 1*a* of the casing 1 and then is circulated by the oil pump 10.

However, the foregoing open scroll compressor according to the related art draws oil introduced into the balancing space 2*a* to the balance weight 8 and discharges it out of the balancing space 2*a*, but when the balance weight 8 is continuously agitated with oil or an amount of oil introduced into the suction space I a of the casing 1 is high, the oil within the suction space la overflows and is collected in the balancing space 2*a*, thereby causing a problem of increasing agitation loss, as well as increasing compressor noise.

Further, according to the related art open scroll compressor, the balancing space 2*a* is formed at a center side rather than in the trust surface 2*b* of the main frame 2, and thus the thrust surface 2*b* of the main frame 2 is formed away in a radial direction, from an axial center of the drive shaft 3, and due to this, a supporting force at a central portion of the orbiting scroll 4 forming a relatively high pressure portion is weakened, thereby causing a problem of aggravating axial leakage when the central portion of the orbiting scroll 4 is released from the fixed scroll 5. Furthermore, according to the related art open scroll compressor, the axially extended portion 2*e* extends in a lengthwise manner in a backward direction (in a direction of the drive pulley 11) of the main frame 2, thereby causing a problem of increasing a size of the main frame 2 made of a relatively heavy casting compared to the sub frame 6, as well as increasing total weight of the scroll compressor.

In addition according to the related art open scroll compressor, a portion of a front end of the balance weight 8 is coupled to the main frame 2 in a butt shape, though the sub frame 6 is coupled between the main frame 2 and the front cover 9, thereby causing a problem of deteriorating a centering operation of the sub frame 6. Also, according to the related art open scroll compressor, a portion at which the main frame 2 is coupled to the sub frame is fastened by a bolt (B); however, as the bolt (B) is fastened in a direction of the main frame 2 from the sub frame 6 a step surface 6*a* capable of supporting a bolt head should be provided at a side of the sub frame 6, thereby causing a problem of increasing an outer diameter of the sub frame 6, as well as increasing an outer diameter of the compressor.

BRIEF DESCRIPTION OF THE DRAWINGS

Embodiments will be described in detail with reference to the following drawings in which like reference numerals refer to like elements, and wherein.

DETAILED DESCRIPTION

Hereinafter, a scroll compressor according to embodiments will be described in detail with reference to the accompanying drawings.

Figure 1:
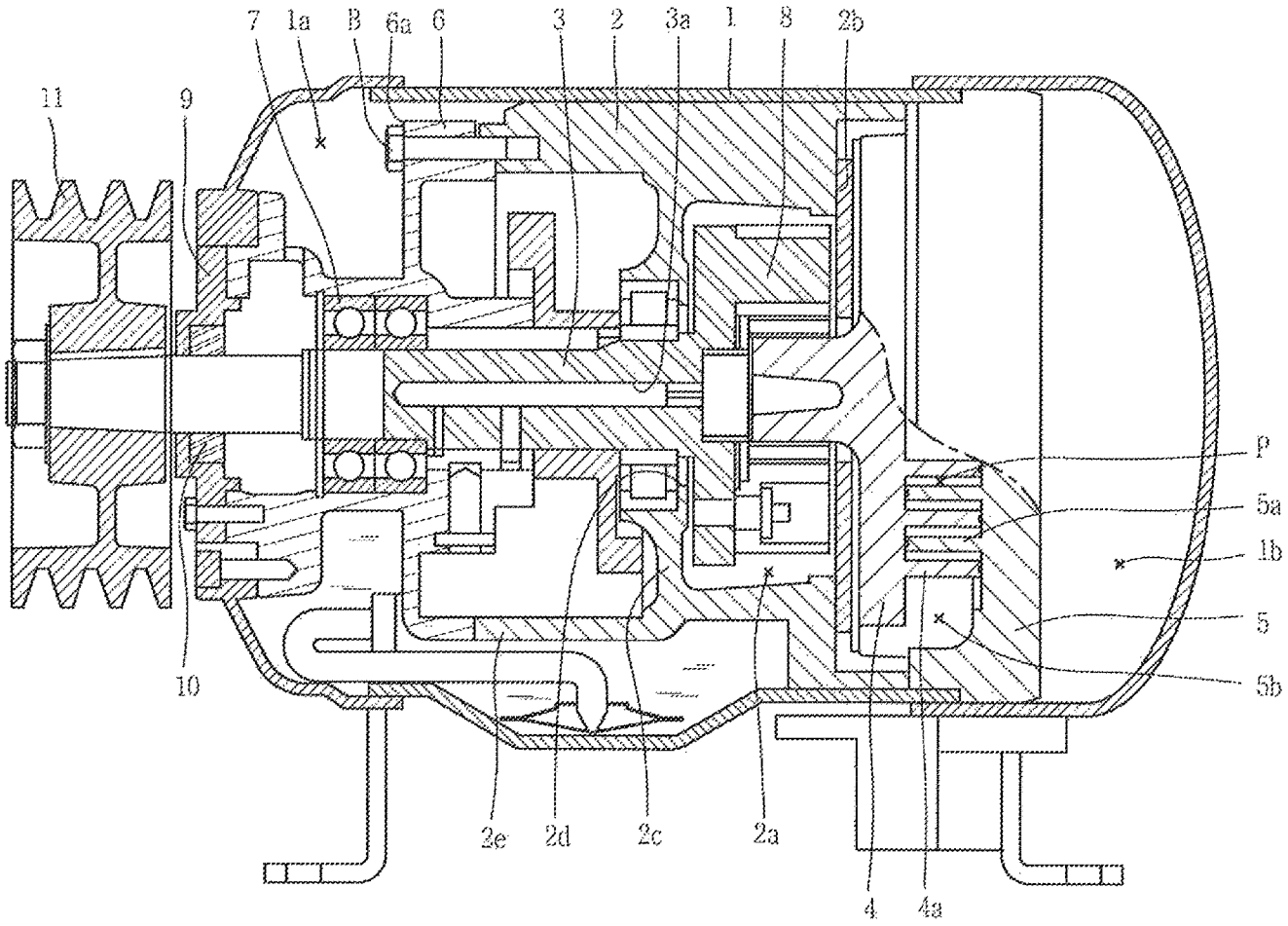
FIG. 1 RELATED ART
FIG. 1 is a longitudinal cross-sectional view of an open scroll compressor according to the related art.
Figure 2:
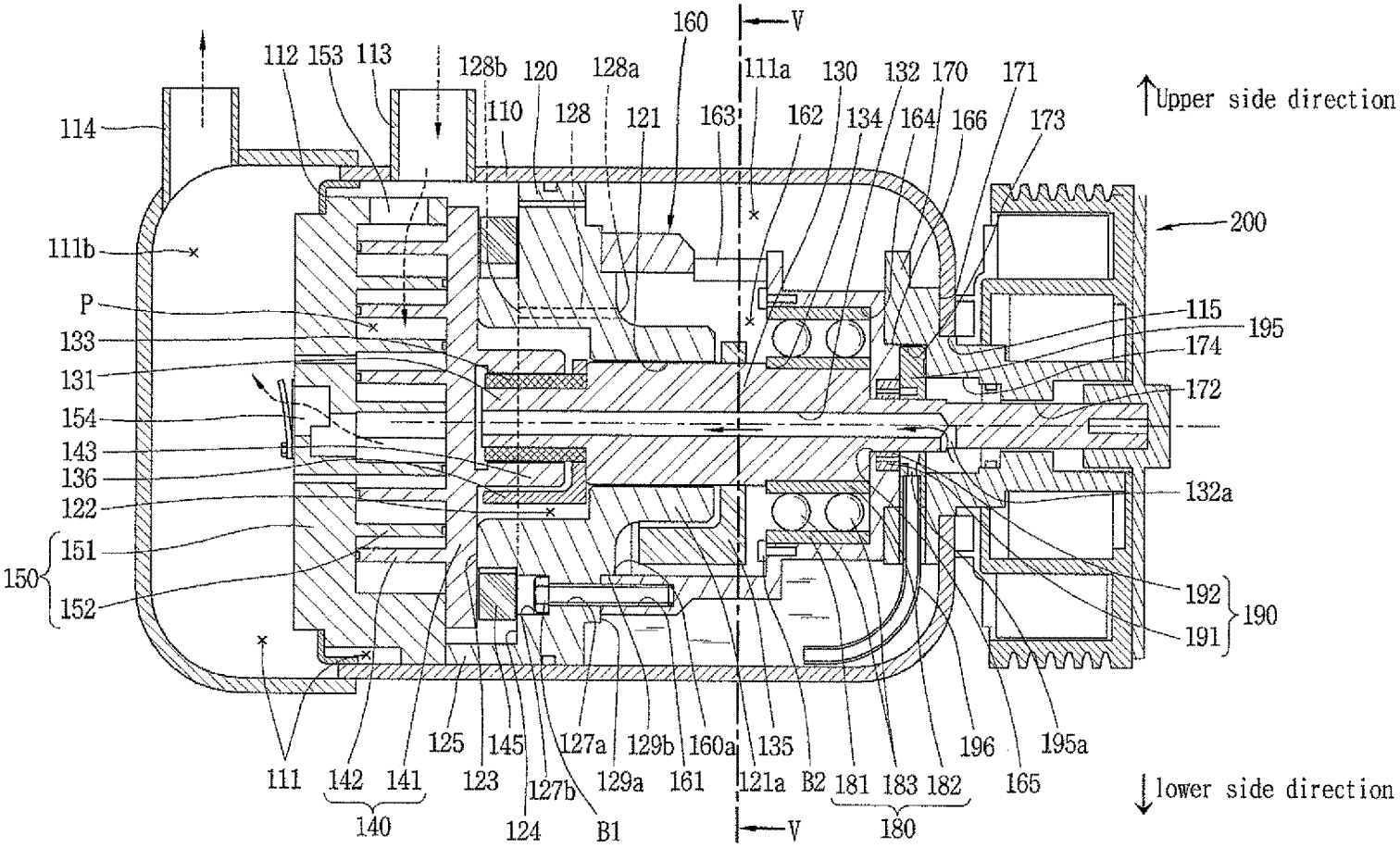
FIG. 2 is a longitudinal cross-sectional view of an open scroll compressor according to an embodiment.
Figure 3:
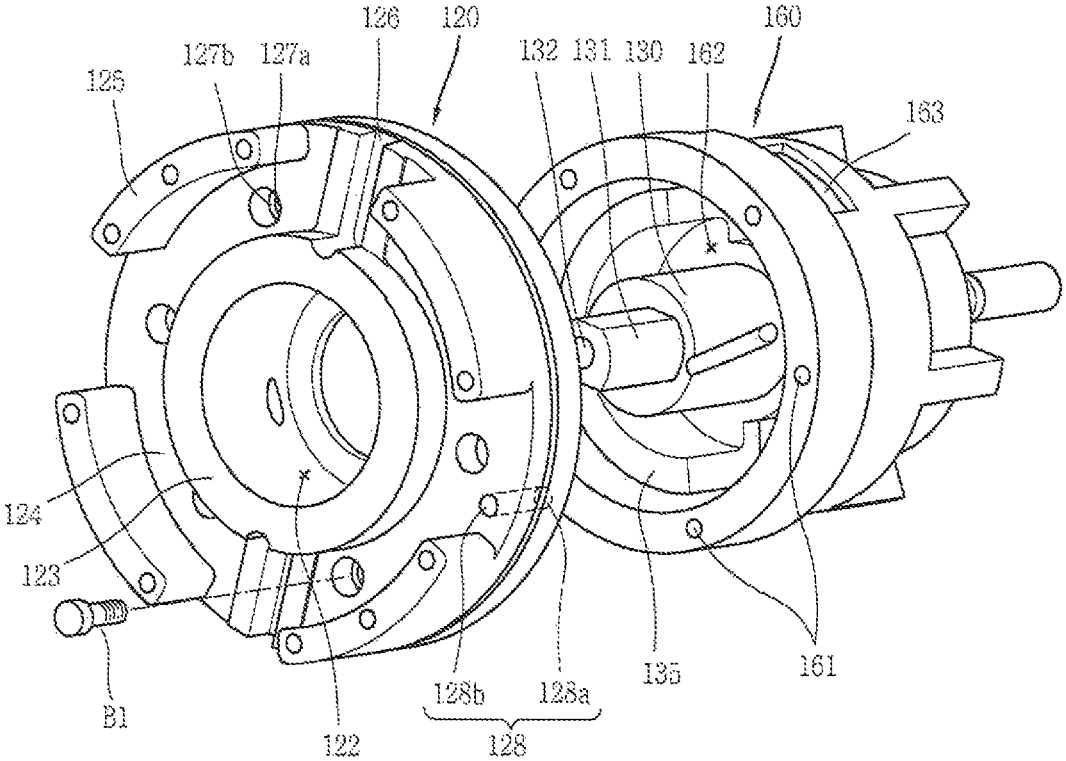
FIG. 3 is a perspective view illustrating that the open scroll compressor of FIG. 2 is divided into a main frame and a sub frame.
Figure 4:
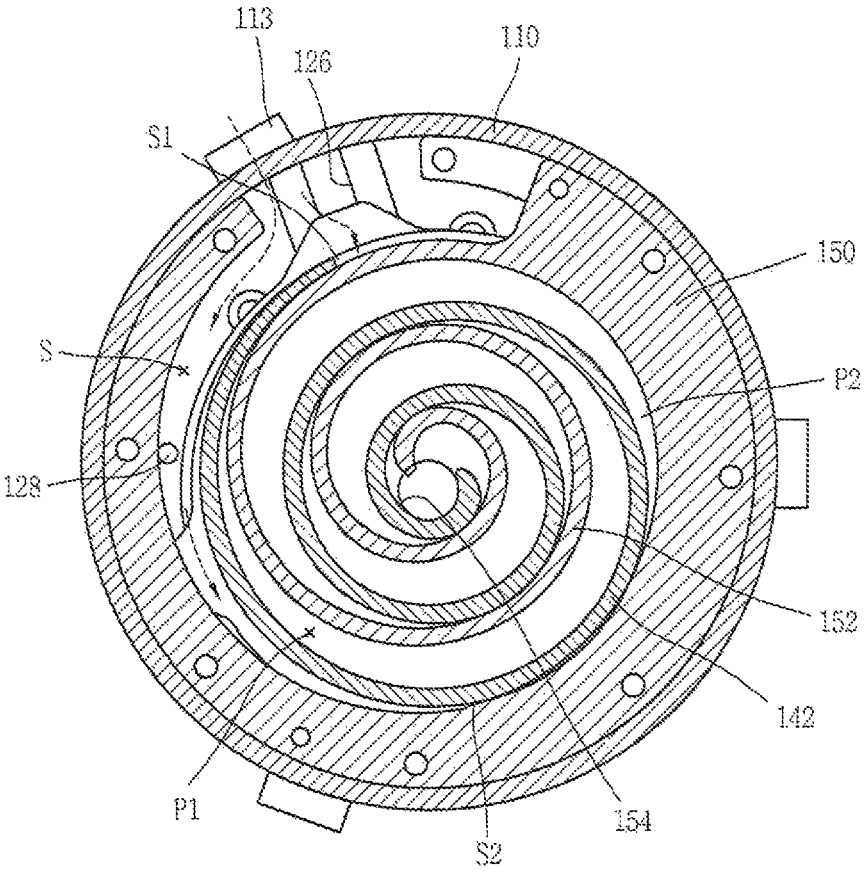
FIG. 4 is a longitudinal cross-sectional view of a compression mechanism in the open scroll compressor of FIG. 2.
Figure 5:
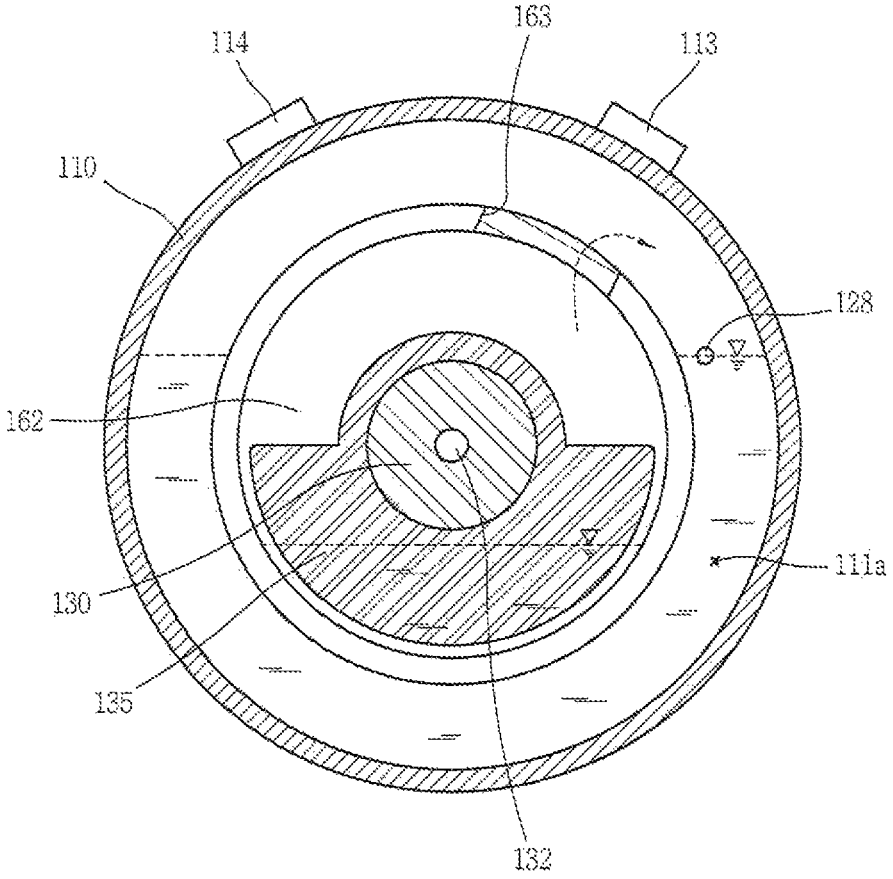
FIG. 5 is a cross-sectional view it a location of an oil discharge hole in the open scroll compressor of FIG. 2, taken along line V-V of FIG. 2.

FIG. 2 is a longitudinal cross-sectional view of an open scroll compressor according to an embodiment. FIG. 3 is a perspective view illustrating that the open scroll compressor of FIG. 2 is divided into a main frame and a sub frame. FIG. 4 is a longitudinal cross-sectional view of a compression mechanism in the open scroll compressor of FIG. 2. FIG. 5 is a cross-sectional view illustrating a location of an all discharge hole in the open scroll compressor of FIG. 2 taken along line V-V of FIG. 2.

As illustrated in the drawings, in an open scroll compressor according to an embodiment, a main frame 120 may be fixed to and installed in an inner space 111 of the casing 110, and an end of a drive shaft 130 may be rotatably coupled to the main frame 120. As illustrated in FIG. 2, the inner space 111 of the casing 110 may be partitioned into a suction space 111*a* having a low pressure and a discharge space 111*b* having a high pressure by a high-low pressure separating plate 112 coupled to a fixed scroll 150, which will be described hereinafter. A suction pipe 113 and a discharge pipe 114 may be connected to the suction space 111*a* and the discharge space 111*b*, respectively. As a result, refrigerant may be suctioned into the suction space 111*a* through the suction pipe 113 and introduced into a plurality of compression chambers (P) to form low-pressure type compressor in which the refrigerant is compressed in the plurality of compression chambers (P) and discharged into the discharge space 111*b* and then moved to a refrigerant pipe through the discharge pipe 114.

As illustrated in FIGS. 2 and 3, an outer circumferential surface of the main frame 120 may be closely adhered to an inner circumferential surface of the casing 110 and may be, for example, shrink-fitted or welded and fixed thereto. Further, a shaft receiving hole 121 having a bush bearing (not shown) that supports a main bearing (not shown) of the drive shaft 130 in a radial direction may be formed in a penetrating manner at a center of the main frame 120, and an orbiting space 122 may be formed at a front end of the shaft receiving hole 121 to provide a boss 143 of the orbiting scroll 140, which will be described hereinafter.

A thrust surface 123 may be formed in an annular shape on a front end surface of the main frame 120 attached to the orbiting space 122, an Oldham ring receiving portion 124, into which an Oldham ring 145 may be inserted, may be formed at an outside of the thrust surface 123, and a plurality of axial protrusions 125 that protrudes in an axial direction, and which may be fastened to the fixed scroll 150 which will be described hereinafter may be formed at predetermined intervals according to a circumferential direction at en outside of the Oldham ring receiving portion 124. A plurality of key grooves 126 may be formed on the Oldham ring receiving portion 124 to be slidably coupled to a key (not shown) of the Oldham ring 145. Further, a bolt head 127*a* to fasten the main frame 120 to a sub frame 160, which will be described hereinafter, with a fastening bolt (B1), and a head groove 127*b*, into which a bolt head may be inserted, may be formed in each of the plurality of key grooves 126.

As illustrated in FIGS. 3 and 5, one or more oil discharge holes 128 may be formed on the main frame 120 to discharge a portion of the oil flowing into the suction space 11 la of the casing 110 in a direction of the plurality of compression chambers P. An inlet of each oil discharge hole 128 may be formed at a height capable of preventing oil flowing into the suction space 11*a* of the casing 110 from flowing into a balancing space 162 of the sub frame 160 above a scatter hole 163 of the sub frame 160, which will be described hereinafter, namely, at a height lower or equal to a height of the scatter hole 163 (the oil discharge hole appears to be formed at an inside of the balancing space 162 in FIG. 2, but is formed at an outside of the balancing space 162 in actuality, as illustrated in FIG. 5). Further, an outlet (a side opposite to the thrust surface) 128*b* of the oil discharge hole 128 may be formed at a location lower or equal to an inlet (a side of the thrust surface) 128*a* may be formed at a physically lower location among the plurality of compression chambers (P (P1, P2)) to communicate with the compression chamber (P2 on the drawing) formed or functioning as a suction chamber, as illustrated in FIG. 4.

As illustrated in FIG. 2 the drive shaft 130 may be formed lengthwise in a transverse direction, a pin 131 coupled to the orbiting scroll 140 in the inner space 111 of the casing 110 may be formed at one or a first end (hereinafter, a "front end") thereof, and a magnetic clutch 200 may be coupled to the other or a second end (hereinafter, a "rear end") thereof at an outside of the casing 110.

An oil passage 132 may be formed in an axially penetrating manner in the drive shaft 130. The oil passage 132 may be formed in an axially penetrating manner through both ends of the drive shaft 130, but as an oil pump 190, which will be described hereinafter, may be coupled to a rear end of the drive shaft 130, an inlet end 132*a* of the oil passage 132 may extend in a penetrating manner from a middle of the drive shaft 130 to an outer circumferential surface thereof.

The pin 131 may be formed at an axial center of the drive shaft 130, and an eccentric bush or sliding bush 133 may be coupled to the pin 131. Further, a sub balance weight 136 that performs an orbiting movement in the orbiting space 122 of the main frame 120 may be coupled to the eccentric bush or sliding bush 133 in a pushing manner.

The orbiting scroll 140 may be coupled to an end of the drive shaft 130, and the non-orbiting scroll (hereinafter, "fixed scroll") 150, which does not perform an orbiting movement, may be coupled to the orbiting scroll 140. The fixed scroll 150 may be coupled to the main frame 120 with the orbiting scroll 140 interposed therebetween. An orbiting wrap 142 and a fixed wrap 152 may be formed on an end plate 141 of the orbiting scroll 140 and an end plate 151 of the fixed scroll 150, respectively. The orbiting wrap 142 and the fixed wrap 152 may be engaged with each other to form the plurality of compression chambers (P) including the suction chamber, the intermediate pressure chamber, and the discharge chamber.

As illustrated in FIGS. 2 and 4, a suction port 153 that communicates with the suction chamber and a discharge port 154 that communicates with the discharge chamber may be formed at an outside of the fixed wrap 152 of the fixed scroll 150 and at a center of the fixed scroll 150, respectively. The suction port 153 may communicate with the suction space 111*a* of the casing 110, and the discharge port 154 may communicate with the discharge space 111*b*.

As the orbiting wrap 142 is formed lengthwise in an asymmetric manner with respect to the fixed wrap 152, the suction port 153 may communicate with an arc-shaped suction groove (S). Whereas the suction groove (S) communicates with inner compression chamber (P1) at an outside end (hereinafter, interchangeably used with a "first suction chamber") (S1) of the orbiting wrap 142, the suction groove (S) may communicate with outer compression chamber (P2) at a location wound inward substantially 180 degrees from the outside end (S1) of the orbiting wrap 142. Accordingly, the inner compression chamber (P1) and the outer compression chamber (P2) may start a suction cycle at same, time to form first suction chamber (S1) and second suction chamber (S2), such that the suction groove (S) or suction port communicates with each compression chamber (P1, P2), respectively. Further, a variable capacity unit or device (not shown) that selectively bypasses a portion of refrigerant compressed in the intermediate pressure chamber may be installed at an outer surface of the end plate 151 of the fixed scroll 150.

Figure 6:
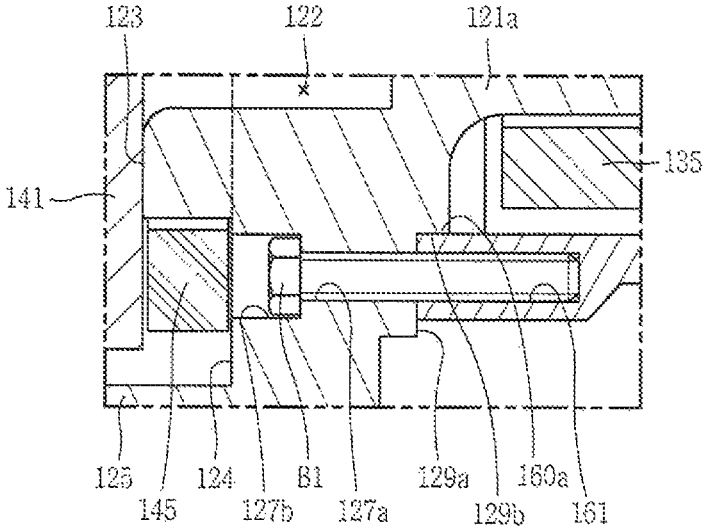
FIG. 6 is a longitudinal enlarged cross-sectional view illustrating a coupling configuration between a main frame and a sub frame in the open scroll compressor of FIG. 2.
Figure 7:
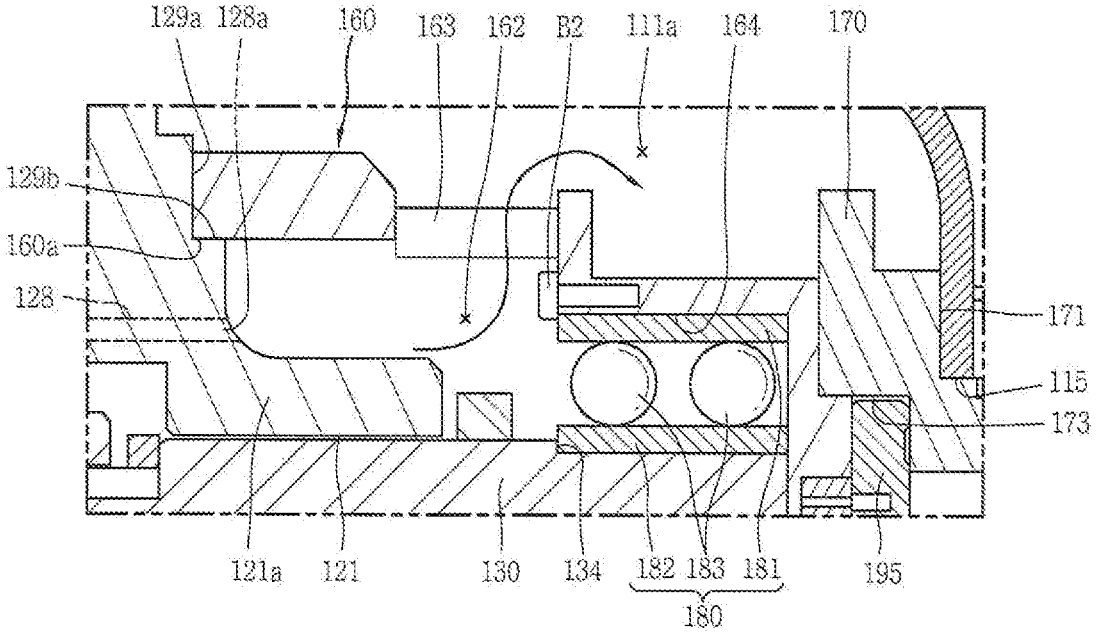
FIG. 7 i a longitudinal cross-sectional view illustrating the coupling structure of he sub frame in the open scroll compressor of FIG. 2.

As illustrated in FIGS. 6 and 7, the sub frame 160 may be coupled to a rear surface of the main frame 120. Further, the sub frame 160 may be coupled to a front cover 170 that extends through the casing 110. An insertion protrusion may be formed between the main frame 120 and the sub frame 160, and between the sub frame 160 and the front cover 170, respectively, to facilitate a centering operation during assembly of the sub frame 160. For example, a shaft receiving portion 121*a*, through which the shaft receiving hole 121 may pass, may extend lengthwise at a rear side of the main frame 120, a coupling surface 129*a*, to which an end of the sub frame 160 may be coupled, may be formed in the shaft receiving portion 121*a*, and a first insertion protrusion 129*b* may be formed at an inner side of the coupling surface 129*a*, in a stepped manner from the coupling surface 129*a*, to be brought into contact with an inner circumferential surface 160*a* of the sub frame 160. The first insertion protrusion 129*b* may be formed in an annular shape or formed with a plurality of protrusions.

The sub frame 160 may be formed of a relatively light material, such as aluminum, in contrast to the main frame 120, which may be fabricated with a casting. Further, the sub frame 160 may be formed in a cylindrical shape, both ends of which may be open, and a plurality of bolt grooves 161 may be formed on a front end surface of the sub frame 160 (in a direction of the compression chamber) to communicate with the bolt hole 127*a* of the main frame 120 so as to be fastened by the fastening bolt (B1).

Figure 8:
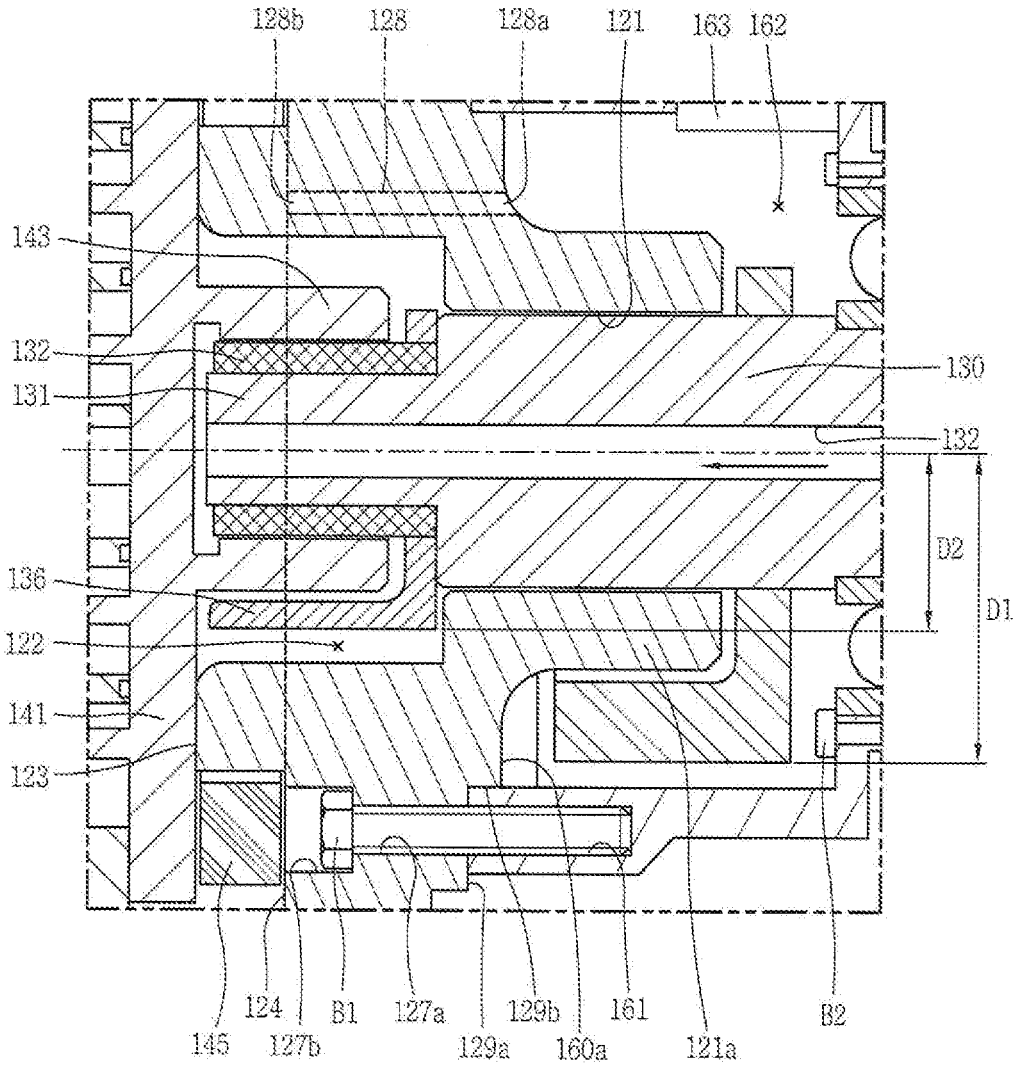
FIG. 8 is a long longitudinal cross-sectional view illustrating a relationship between a balance weight and a thrust surface in an outer circumferential surface of the open scroll compressor of FIG. 2.

As illustrated in FIG. 8, the balancing space 162 may be formed at a front side of the sub frame 160 to accommodate a main balance weight 135. The main balance weight 136 may be inserted into and coupled to the drive shaft 130, and a radius (D1) of the main balance weight 135 may be formed to be larger that a radius (D2) of the sub balance weight 136. Accordingly, as an inner diameter of the orbiting space 122 may be formed to be smaller than an inner diameter of the balancing space 162, at least a portion of the thrust surface 123 of the main frame 120 may be located within a range of the radius (D1) of the main balance weight 135 even though the sub balance weight 136 is provided in the orbiting space 122 of the main frame 120, thereby enhancing a supporting force for the central portion of the orbiting scroll 140 to the extent.

Further, as illustrated in FIGS. 2 through 5, the scatter hole 16 may be formed on a sidewall surface forming the balancing space 162 of the sub frame 160 to allow oil, which has been supplied to a sliding portion through the oil passage 132 of the drive shaft 130, to flow into an inner portion of the balancing space 162. The scatter male 163 may be formed at a height capable of preventing oil filled into the suction space 111*a* of the casing 110 from overflowing into the sub frame 160 through the oil discharge hole 128, for example, above a medium or midline height of the casing 110.

A bearing space 164 may be formed at one side of the balancing space 162, into which a sub bearing 180 to support a sub bearing (not shown) of the drive shaft 130 in a radial direction may be inserted and fixed. A bolt (B2) may be fastened to a front side of the bearing space 164 to support an outer ring 181 of the sub bearing 180 inserted into the bearing space 164 in an axial direction. An inner ring 182 of the sub bearing 180 may be pressed and coupled to a bearing support surface 134 of the drive shaft 130 while being supported in an axial direction, as illustrated in FIG. 8. Further, a shaft hole 165 may be formed at a rear lateral surface of the sub frame 160 to allow the drive shaft 130 to pass therethrough, and a second insertion protrusion 166 may be formed at a front end surface of the shaft hole 165 to be inserted into and fixed to the front cover 170 in a radial direction.

Another end of the outer ring 181 and the inner ring 182 of the sub bearing 180 may be supported at an inner side of a rear lateral surface of the sub frame 160. The sub bearing 180 may be formed in a double, row angular contact ball bearing shape, in which at least one ball 183 may be provided in a double row between the outer ring 181 and inner ring 182.

Figure 9:
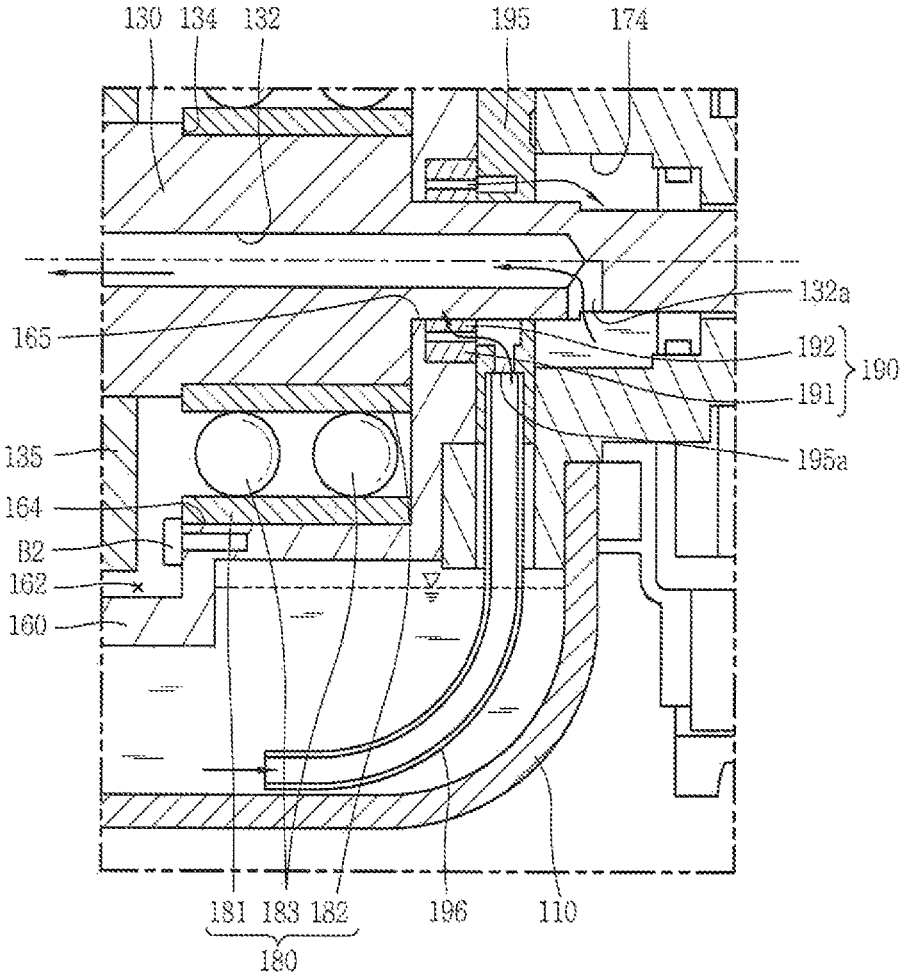
FIG. 9 is a longitudinal cross-sectional view illustrating an oil supply structure in the open scroll compressor of FIG. 2.

As illustrated in FIG. 9, the oil pump 190 to pump oil stored in the casing 110 to the sliding portion and the compression mechanism may be installed at an outer side of the rear lateral surface of the sub frame 160. An outer ring 191 of the oil pump 190 may be fixed to the sub frame 160, whereas an inner ring 192 of the oil pump 190 may be coupled to the drive shaft 130. As result, when the drive shaft 130 rotates, the inner ring 192 of the oil pump 190 may pump oil stored in the casing 110 while performing a relative movement with respect to the outer ring 191.

The front cover 170 coupled to the casing 110 in a penetrating manner may be coupled to a front end surface of a rear side of the sub frame 160. The front cover 170 may have a predetermined length in an axial direction, and an outer circumferential surface thereof may be formed in a cylindrical shape with several steps. A sealing surface 171 closely adhered to a penetration hole 115 of the casing 110 to seal the inner space 111 of the casing 110 may be formed on an outer circumferential surface of the front cover 170. A shaft hole 172, through which the drive shaft 130 may pass, may be formed at a center of the front cover 170. A cover space 173 may be formed at a center of a front end surface of the front side of the front cover 170 to accommodate a pump cover 195 that supports the oil pump 190, and an oil flow space 174 may be formed at a rear side of the cover space portion 173 to guide oil pumped by the oil pump 190 to the oil passage 132 of the driving shaft 130. An inlet end 132*a* may be formed on the drive shaft 130 in a radial direction to communicate the oil flow space 174 with the oil passage 132. An all supply hole 195*a* may be formed on the pump cover 195, and an oil supply pipe 196 may be inserted into and coupled to the oil supply hole 195*a* to guide oil collected on a bottom surface of the suction space 111*a* of the casing 110 to a suction pocket of the oil pump 190.

Operation of the above-described open scroll compressor according to an embodiment is discussed hereinafter.

When operation of an air conditioner is selected, the magnetic clutch 200 may be coupled to a drive pulley (not shown) to transmit an external drive force to the orbiting scroll 140 through the drive shaft 130. Then, the orbiting scroll 140 may perform an orbiting movement by an eccentric distance in a state of being supported by the main frame 120, and at a same time, a plurality of compression chambers (P) including a suction chamber, an intermediate pressure chamber, and a discharge chamber between the orbiting wrap 142 and fixed wrap 152 may be consecutively formed. The plurality of compression chambers (P) may move to a center due to a continuous orbiting movement, of the orbiting scroll 140, consecutively suctioning in, compressing, and discharging a volume of refrigerant.

At this time, oil may be discharged along with the refrigerant, and circulated through a cooling cycle of the air conditioner and then collected into the suction space 111*a* of the casing 110 through the suction pipe 113. The oil may be pumped by a pumping force of the oil pump 190 and supplied to each sliding portion and the compression mechanism through the oil passage 132 of the drive shaft 130.

Then, a portion of oil supplied between the orbiting scroll 140 and the drive shaft 130 through the oil passage 132 may flow downward and be collected into the balancing space 162 of the sub frame 160. The oil may be forced up by the main balance weight 135 when the main ba lance weight 135 rotates along with the drive shaft 130 and discharged to the suction space 111*a* of the casing 110 through the scatter hole 163. Accordingly, even when oil flows into the balancing space 162 of the sub frame 160, it may be possible to reduce agitation loss between the oil and the main balance weight 135.

However, when an amount, of oil flowing into the inner space 111 of the casing 110 is large, a portion of the oil may flow into the balancing space 162 above the scatter hole 163 of the sub frame 160. In particular, a large amount of oil may flow into the inner space 111 of the casing 110 according to an operation condition of the air conditioner, and in this case, a significant amount of oil filled into the inner space 111 of the casing 110 may overflow into the balancing space 162 through, the scatter hole 163, and thus, oil that flows into the balancing space 162 cannot be discharged cut of the sub frame 160 with a scattering method using the main balance weight 135, thereby significantly increasing agitation loss or noise.

Taking this into account, according to this embodiment, the oil discharge hole 128 may be formed on the main frame 120 to communicate the suction space 111*a* of the casing 110 with the plurality of compression chambers (P) to move oil flowing into the suction space 111*a* of the casing 110 to the plurality of compression chambers (P) and discharge the oil along with refrigerant to the cooling cycle of the air conditioner Accordingly, it may be possible to suppress oil in the inner space 111 of the casing 110 from flowing into the balancing space 162 through the scatter hole 163 of the sub frame 160.

At this time, an amount of oil flowing into the plurality of compression chambers (P) may be less than about 10% compared to an amount of refrigerant suctioned into the plurality of compression chambers (P), and thus, inhalation loss of refrigerant may be a negligible amount.

In addition, a lower pressure scroll compressor, in which the suction pipe 113 communicates with the suction space 111*a*, may have a plurality of suction chambers (S1, S2) due to its characteristics, and thus, the oil discharge hole 128 should be formed to communicate with both suction chambers (S1, S2) to allow oil to uniformly flow into the inner compression chamber (P1) and the outer compression chamber (P2) while uniformly supplying the amount of refrigerant suctioned into both compression chambers to a certain extent. However, when the casing 110 is installed in a traverse direction both suction chambers (S1, S2) are formed to have an angle of circumference of about 180 degrees, and thus, the second suction chamber (S2) and the first suction chamber (S1) are located at a lower side and an upper side, respectively. Accordingly, oil is not allowed to be introduced into the suction chamber (S1) located at an upper side, and as a result, the oil may flow into the compression chamber only through the suction chamber (S2) located at the lower side.

However, even when oil flows only into the suction chamber located at the lower side, as described above, a minute clearance between the end plates 151, 141 may occur at a front end surface of the orbiting wrap 142 and the fixed wrap 152, respectively, and thus, the oil may infiltrate into the other compression chambers through the clearance, thereby suppressing unbalance in the refrigerant or oil. In addition, even when oil does not directly flow into one compression chamber through the oil discharge hole 128, a predetermined amount of oil may be contained in the refrigerant suctioned into the compression chamber, thereby suppressing oil shortage in the compression chamber to a certain extent.

In particular, oil introduced into the suction chamber (S) through the oil discharge hole 128 may flow into the suction chamber of the compression chamber having a relatively higher compression ratio among a plurality of suction chambers (S1, S2) forming a portion of both of the compression chambers (P1, P2). In this case, a pressure difference may occur between the compression chambers (P1, P2), and oil flowing into the relevant compression chamber through the oil discharge hole 128 may be leaked in an axial direction into the other compression chamber through a clearance occurring at an axial end of the wrap, thereby compensating an unbalance of refrigerant and oil between the compression chamber.

An oil discharge hole in an open scroll compressor according to an embodiment will be described hereinafter.

Figure 10:
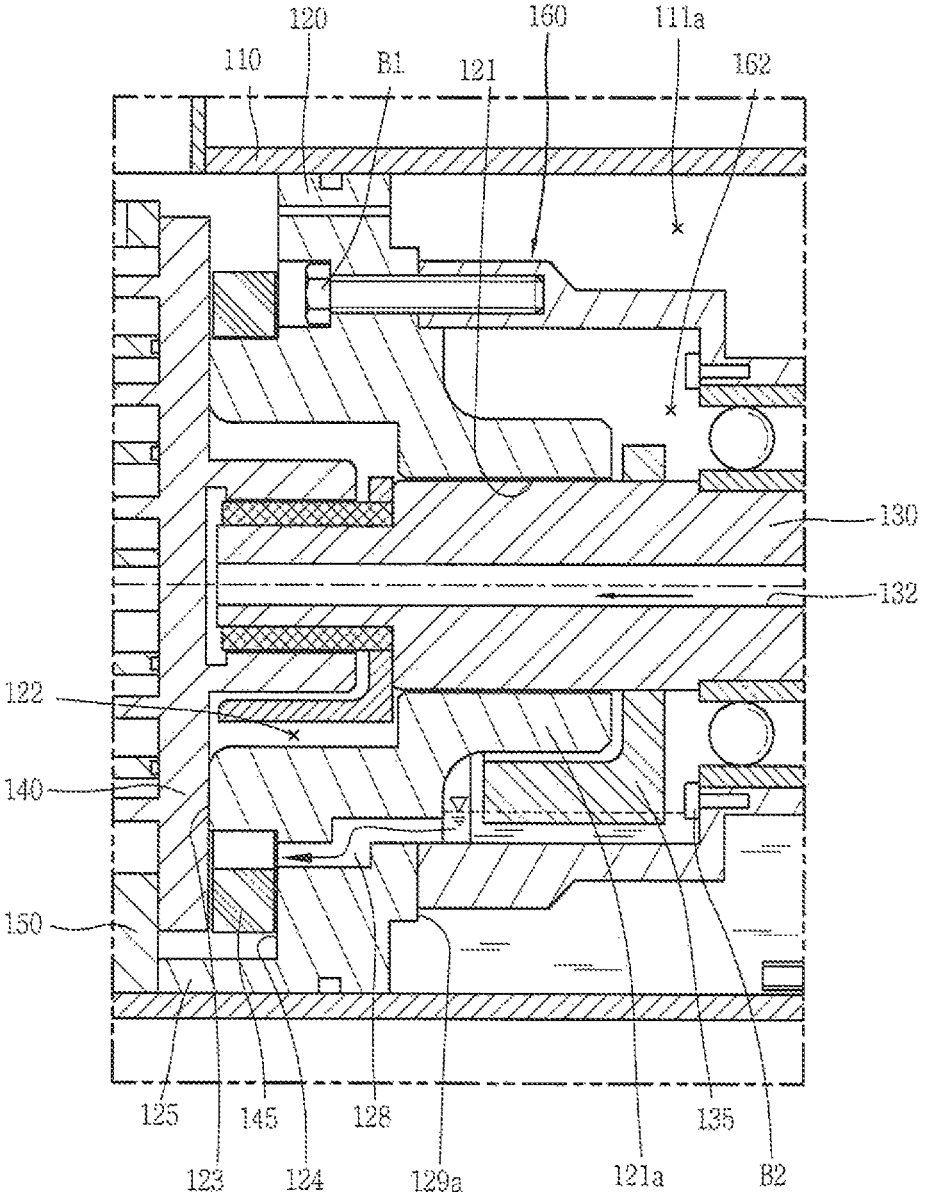
FIG. 10 is a longitudinal cross-sectional view illustrating another embodiment of a location of an oil discharge hole in an open scroll compressor according to an embodiment.

The oil discharge hole 128 may be formed at a location that communicates with the inner space 111 of the casing 110, namely, located out of the sub frame 160 according to the previous embodiment, but the oil discharge hole 128 may be formed at an inner side of the balancing space 162 of the sub frame 160 to communicate with the plurality of compression chambers (P) according to this embodiment, as illustrated in FIG. 10. In this case, the oil discharge hole 128 may communicate with a suction groove using an additional pipe or a protrusion may be formed on the main frame 120 to communicate with the suction groove.

Further, the oil discharge hole 128 may be formed at a lower location than a medium or midline height of the balancing space 162, for example, adjacent to a lowest point, to immediately discharge oil flowing into the balancing space 162 in a direction of the compression chamber, that is, the suction chamber, thereby maintaining oil collected within the balancing space 162 to a minimum. Furthermore, in this case, oil flowing into the balancing space 162 may be immediately discharged in a direction of the compression chamber through the oil discharge hole 128, and thus, formation of an additional scatter hole on the sub frame 160 may not be required as the oil does not remain within the balancing space 162, thereby facilitating processing of the sub frame 160.

When the oil discharge hole 128 communicates with an inner portion of the balancing space 162, as described above, oil flowing into the balancing space 162 may be immediately discharged to easily discharge the oil of the balancing space 162, thereby reducing agitation loss and noise occurring while the oil is agitated with the main balance weight 135. In addition, the scatter hole may be removed to suppress oil flowing into the balancing space 162 even when a large amount of oil flows into the inner space 111 of the casing 110, thereby more effectively reducing agitation loss and noise occurring while the oil is agitated by the main balance weight 135.

Embodiments disclosed herein provide a scroll compressor in which oil may be suppressed from being introduced into or remaining in a balancing space, thereby minimizing agitation loss due to oil agitation in the balancing space. Embodiments disclosed herein, further provide scroll compressor in which a thrust surface of the main frame is formed adjacent to an axial center of the drive shaft, thereby suppressing axial leakage while a central portion of the orbiting scroll is released from the fixed scroll.

Further, embodiments disclosed herein provide a scroll compressor in which a size of the main frame is reduced, thereby reducing a total weight of the compressor. Furthermore, embodiments disclosed herein provide a scroll compressor capable of facilitating a centering operation of the sub frame Also, embodiments disclosed herein also provide a scroll compressor in which an outer diameter of the sub frame due to a coupling structure between the main frame and sub frame is suppressed from being increased, thereby accomplishing miniaturization of the compressor.

With the embodiments disclosed herein, oil collected in the suction space of the casing may be discharged to the compression chamber to prevent the oil from being introduced into the balancing space in advance or discharge the oil collected in the inner space of the sub frame to the compression chamber. In addition, the balance weight may be installed within the sub frame to move a thrust surface of the main game to a rear central portion of the orbiting scroll. Also, a member coupled to the sub frame may be assembled in a fitting manner.

Embodiments disclosed herein provide a scroll compressor that may include a casing divided into a suction space and a discharge space, wherein oil is stored in the suction space; a main frame fixed and installed or provided in the suction space of the casing; a fixed scroll coupled to the main frame; an orbiting scroll engaged with the fixed scroll to form a pair of two compression spaces, consisting of suction chambers, intermediate pressure chambers, and discharge chambers while performing a relative movement; a drive shaft coupled to the orbiting scroll to transmit a drive force to the orbiting scroll; at least one balance weight coupled to the drive shaft to eliminate an eccentric load; and a sub frame disposed or provided in the suction space of the casing, and coupled to the main frame to support the drive shaft along with the main frame. A balancing, space portion or balancing space may be formed on a surface corresponding to the main frame to accommodate the balance weight.

An oil discharge hole may be formed on the main frame to introduce the oil collected in the balancing space portion into the compression space and an inlet of the oil discharge hole may be formed to communicate with the balancing space portion. Further, the oil discharge hole may be formed at a lower location than a medium or midline height of the balancing space portion.

An oil discharge hole may be formed on the main frame to introduce the oil collected in the suction space into the compression space or chamber, and an inlet of the oil discharge hole may be formed at an outer side than the balancing space portion.

A scatter hole that communicates between the balancing space portion and the suction space may be formed on the sub frame. The oil discharge hole may be formed to be lower than the scatter hole.

An oil discharge hole configured to introduce oil flowing into the suction space or oil flowing into the balancing space portion to the compression space may be formed on the main frame. An outlet of the, oil discharge hole may be communicate with a suction chamber at a side of the compression space having a relatively higher compression ratio among each suction chamber constituting the plurality of compression spaces.

A bearing receiving portion may be formed on the sub frame to accommodate a bearing that supports the drive shaft in a radial direction. The bearing receiving portion may be formed to be open at a side of the balancing receiving portion.

Further, an inner diameter of the bearing receiving portion may be formed to be equal to or less than inner diameter of the balancing receiving portion. In addition, an insertion protrusion may be formed at a member corresponding to an end portion of the sub frame to support an inner circumferential surface or an outer circumferential surface of the sub frame in a radial direction.

The balance weight may include a main balance weight and a sub balance weight. The main balance weight may be provided in a balancing space portion or balancing space of the sub frame, and the sub balance weight may be provided in an orbiting space portion or orbiting space formed on the main frame. An inner diameter of the orbiting space portion may be formed to be less than an inner diameter of the balancing space portion.

The main frame and sub frame may be coupled with a fastening bolt. A head insertion groove, into which a head portion of the fastening bolt may be inserted, may be formed on the main frame. The head insertion groove may be formed at an outer side than a thrust surface of the main frame.

In addition, a surface do which the main frame is brought into contact with the sub frame in an axial direction may be formed to be shorter than a length to an end of the shaft receiving portion of the main frame based on a thrust surface of the main frame. The sub frame may be formed of a more rigid material than the main frame.

Embodiments disclosed herein further provide a scroll compressor that may include a casing divided into a suction space and, a discharge space, wherein oil is stored in the suction space, a fixed scroll installed or provided in a suction space of the casing; an orbiting scroll engaged with the fixed scroll to form a pair of two compression spaces consisting of suction chambers, intermediate pressure chambers and discharge chambers while performing a relative movement; a drive shaft coupled to the orbiting scroll to transmit a drive force to the orbiting scroll; a main balance weight and a sub balance weight coupled to both sides of the drive shaft by interposing a predetermined distance therebetween to eliminate an eccentric load; a main frame configured to support the drive shaft in a radial direction, and coupled to the fixed scroll to support the orbiting scroll in an axial direction, wherein an orbiting space portion or orbiting space that accommodates the sub balance weight may be formed on a surface corresponding to the orbiting scroll; and a sub frame coupled to the main frame to support the drive shaft, wherein a balancing space portion or balancing space that accommodates the main balance weight may be formed on a surface corresponding to the main frame, and the balancing space portion may be formed to have an inner diameter smaller than an inner diameter of the orbiting space portion.

An oil discharge hole may be formed on the main frame to introduce the oil collected in the balancing space portion into the compression space, and an inlet of the oil discharge hole may be formed to communicate with the balancing space portion. Further, an oil discharge hole configured to introduce oil flowing into the suction space or oil flowing into the balancing space portion to the compression space may be formed on the main frame, and an outlet of the oil discharge hole may be communicate with a suction chamber at a side of the compression space having a relatively higher compression ratio among each suction chamber constituting the plurality of compression spaces.

An oil discharge hole may be formed on the main frame to introduce the oil collected in the suction space into the compression space. An inlet of the oil discharge hole may be formed at an outer side than the balancing space portion.

A scatter hole that communicates between the balancing space portion and the suction space may be formed on the sub frame. The oil discharge hole may be formed to be lower than the scatter hole.

A bearing receiving portion may be formed on the sub frame to accommodate a bearing that supports the drive shaft in a radial direction. The bearing receiving portion may be formed to be open at a side of the balancing receiving portion.

A surface on which the main frame is brought into contact with the sub frame in an axial direction may be formed to be shorter than a length to an end of the shaft receiving portion based on a thrust surface of the main frame. The sub frame may be formed of a more rigid material than the main frame.

In a scroll compressor according to embodiments disclosed herein, a balancing space may be formed in the sub frame to accommodate at least one balance weight, thereby simplifying a structure of the main frame and reducing a weight thereof to accomplish a light weight scroll compressor. In addition, an oil discharge hole configured to introduce the oil collected in the suction space to the compression space may be formed on an outside of the sub frame, thereby suppressing oil collected in the suction space from flowing into the balancing space. Further, the oil discharge hole may be formed to be lower than the scatter hole, thereby suppressing all collected in the suction space from flowing into the balancing space through the scatter hole.

Also, an oil discharge hole configured to introduce the oil of the balancing space to the compression space may be formed on the main frame to communicate with the balancing space, thereby quickly discharging oil even though a predetermined amount of oil flows into the balancing space, as well as facilitating processing as an additional scatter hole is not required for the sub frame. Further, the oil discharge hole may be formed at a lower location than a medium or midline height of the balancing space, thereby reducing an amount of oil collected in the balancing space to a minimum to minimize agitation loss.

In addition, an outlet of the oil discharge hole may be formed to communicate with a suction port that communicates with the suction chamber at a side of the compression space having a relatively higher compression ratio among a plurality of suction ports that communicates with the suction chambers of the both compression spaces, respectively, to allow oil to flow from a side with a high compression ratio to a side with a low compression ratio due to a pressure difference so as to supply oil to both compression spaces with only a single oil discharge hole, thereby obtaining an effect of facilitating fabrication as well as effectively reducing axial leakage between the compression spaces.

Further, a bearing receiving portion may be formed to accommodate a bearing that supports the drive shaft in a radial direction, and the bearing receiving portion may be formed to communicate with a side of the balancing receiving portion so as to be open, and thus, a ball bearing may be inserted from the side of the balancing receiving portion to the side of the bearing receiving portion, thereby enhancing assembly of the ball bearing. Furthermore, an insertion protrusion may be formed on a member corresponding to an end portion of the sub frame to support an inner circumferential surface or outer circumferential surface of the sub frame in a radial direction to facilitate arrangement of an assembly location of the sub frame during assembly of the sub frame, thereby quickly and accurately performing a centering operation of the sub frame. Also, an outer diameter of the sub balance weight may be formed to be less than an outer diameter of the main balance weight to form an inner diameter of the orbiting space to be less than an outer diameter of the balancing space, and thus, a thrust surface that supports the orbiting scroll may be located in a direction of the drive shaft, namely, at a side of a center of the orbiting scroll, thereby effectively suppressing axial leakage while enhancing a supporting force to the central portion of the orbiting scroll.

In addition a head insertion groove, into which a head portion of the fastening bait may be inserted, may be formed on the main frame, and thus, a portion that accommodates a bolt head may not be required for the sub frame, thereby preventing an outer diameter of the sub frame from being increased, as well as reducing a diameter of the scroll compressor. Further, the head insertion groove may be formed at an outer side than a thrust surface of the main frame to locate the thrust surface adjacent to an axial center of the drive shaft, thereby enhancing a supporting force to a central portion of the orbiting scroll. In addition, the sub frame may be formed of a more rigid material than the main frame to reduce a weight of the main frame fabricated with a relatively heavy casting, thereby reducing a total weight of the scroll compressor.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic, in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing divided into a suction space and a discharge space, wherein oil is stored in the suction space;

a main frame provided in the suction space of the casing;

a fixed scroll coupled to the main frame;

an orbiting scroll engaged with the fixed scroll to form a plurality of compression chambers including a suction chamber, an intermediate pressure chamber, and a discharge chamber while performing a relative movement;

a drive shaft coupled to the orbiting scroll to transmit a drive force to the orbiting scroll;

at least one balance weight coupled to the drive shaft to eliminate an eccentric load; and a sub frame provided in the suction space of the casing, and coupled to the main frame to support the drive shaft along with the main frame, wherein a balancing space is formed on a surface of the sub frame facing the main frame to accommodate the at least one balance weight wherein an oil discharge hole is formed on the main frame to introduce the oil collected in the suction space into the plurality of compression chambers, an inlet of the oil discharge hole is formed outside of the balancing space, and a scatter hole that provides communication between the balancing space and the suction space is formed on the sub frame and wherein the oil discharge hole is formed to be lower than the scatter hole.

2. The scroll compressor of claim 1, wherein an outlet of the oil discharge hole communicates with the suction chamber, which has a higher compression ratio among the plurality of compression chambers.

3. The scroll compressor of claim 1, wherein a bearing receiving space is formed on the sub frame to accommodate a bearing that supports the drive shaft in a radial direction, and wherein one side of the bearing receiving space is formed to be open at a side of the balancing space.

4. The scroll compressor of claim 3, wherein an inner diameter of the bearing receiving space is formed to be equal to or less than an inner diameter of the balancing space.

5. The scroll compressor of claim 1, wherein at least one insertion protrusion is formed at an end portion of the sub frame to support an inner circumferential surface or an outer circumferential surface of the sub frame in a radial direction.

6. The scroll compressor of claim 1, wherein the at least one balance weight includes a main balance weight and a sub balance weight, wherein the main balance weight is provided in the balancing space of the sub frame, and the sub balance weight is provided in an orbiting space formed on the main frame, and wherein an inner diameter of the orbiting space is less than an inner diameter of the balancing space.

7. The scroll compressor of claim 1, wherein the main frame and the sub frame are coupled with at least one fastening bolt, and at least one head insertion groove, into which a head portion of the at least one fastening bolt is inserted, is formed on the main frame.

8. The scroll compressor of claim 7, wherein the at least one head insertion groove is formed at an outside of a thrust surface of the main frame with respect to a central longitudinal axis of the scroll compressor.

9. The scroll compressor of claim 1, wherein a surface, at which the main frame is brought into contact with the sub frame in an axial direction, is formed to be shorter than a length to an end of the shaft receiving portion of the main frame with respect to a thrust surface of the main frame, and wherein the sub frame is formed of a more rigid material than the main frame.

10. A scroll compressor, comprising:

a casing divided into a suction space and a discharge space, wherein oil is stored in the suction space;

a fixed scroll provided in the suction space of the casing;

an orbiting scroll engaged with the fixed scroll to form a plurality of compression chambers including a suction chamber, an intermediate pressure chamber, and a discharge chamber while performing a relative movement;

a drive shaft coupled to the orbiting scroll to transmit a drive force to the orbiting scroll;

a main balance weight and a sub balance weight coupled to the drive shaft with a predetermined distance therebetween to eliminate an eccentric load;

a main frame configured to support the drive shaft in a radial direction, and coupled to the fixed scroll to support the orbiting scroll in an axial direction, wherein an orbiting space that accommodates the sub balance weight is formed on a surface facing the orbiting scroll; and a sub frame coupled to the main frame to support the drive shaft, wherein a balancing space that accommodates the main balance weight is formed on a surface of the sub frame facing the main frame, and wherein the balancing space is formed to have an inner diameter larger than an inner diameter of the orbiting space.

11. The scroll compressor of claim 10, wherein an oil discharge hole is formed on the main frame to introduce oil collected in the balancing space into the plurality of compression chambers, and wherein an inlet of the oil discharge hole communicates with the balancing space.

12. The scroll compressor of claim 11, wherein an oil discharge hole configured to introduce oil flowing into the suction space or oil flowing into the balancing space to the plurality of compression chambers is formed on the main frame, and wherein an outlet of the oil discharge hole communicates with the suction chamber at a side of the plurality of compression chambers having a relatively higher compression ratio among each suction chamber forming the plurality of compression chambers.

13. The scroll compressor of claim 10, wherein an oil discharge hole is formed on the main frame to introduce oil collected in the suction space into the plurality of compression chambers, and wherein an inlet of the oil discharge hole is formed outside of the balancing space.

14. The scroll compressor of claim 13, wherein a scatter hole that provides communicates between the balancing space and the suction space is formed on the sub frame, and the oil discharge hole is formed to be lower than the scatter hole.

15. The scroll compressor of claim 10, wherein a bearing receiving space is formed on the sub frame to accommodate a bearing that supports the drive shaft in a radial direction, and wherein one side of the bearing receiving space is formed to be open at a side of the balancing space.

16. The scroll compressor of claim 10, wherein a surface, at which the main frame is brought into contact with the sub frame in an axial direction, is formed to be shorter than a length to an end of the shaft receiving portion with respect to a thrust surface of the main frame, and wherein the sub frame is formed of a more rigid material than the main frame.

* * * * *